US009025989B2

(12) United States Patent
Murasaki

(10) Patent No.: US 9,025,989 B2
(45) Date of Patent: May 5, 2015

(54) IMAGE HEATING APPARATUS

(71) Applicant: Canon Kabushiki Kaisha, Tokyo (JP)

(72) Inventor: Satoshi Murasaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 14/227,296

(22) Filed: Mar. 27, 2014

(65) Prior Publication Data

US 2014/0212165 A1 Jul. 31, 2014

Related U.S. Application Data

(62) Division of application No. 13/461,133, filed on May 1, 2012, now Pat. No. 8,725,025.

(30) Foreign Application Priority Data

May 2, 2011 (JP) ..... 2011-102994

(51) Int. Cl.
*G03G 21/20* (2006.01)
*G03G 15/20* (2006.01)

(52) U.S. Cl.
CPC .... *G03G 15/2017* (2013.01); *G03G 2221/1645* (2013.01)

(58) Field of Classification Search
USPC ..... 399/328, 329, 341, 92
See application file for complete search history.

(56) References Cited

U.S. PATENT DOCUMENTS

| | | | |
|---|---|---|---|
| 7,609,991 | B2 | 10/2009 | Koshida |
| 7,890,014 | B2 | 2/2011 | Koshida |
| 8,086,131 | B2 | 12/2011 | Koshida |
| 2007/0059023 | A1 | 3/2007 | Koshida |
| 2008/0056755 | A1 | 3/2008 | Koshida |
| 2011/0097102 | A1 | 4/2011 | Koshida |

FOREIGN PATENT DOCUMENTS

| | | | |
|---|---|---|---|
| JP | 4-51179 | A | 2/1992 |
| JP | 2003-076209 | A | 3/2003 |
| JP | 2006-267426 | A | 10/2006 |
| JP | 2007-078984 | A | 3/2007 |
| JP | 2008-052031 | A | 3/2008 |
| JP | 2008-058378 | A | 3/2008 |
| JP | 2008-062031 | A | 3/2008 |

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image heating apparatus includes a rotatable fixing member; an air-blowing unit for blowing air onto an end portion of the rotatable fixing member with respect to a generating line direction of the rotatable fixing member, wherein the air-blowing unit includes a fan, a duct for guiding the air generated by drive of the fan, and a shutter, provided at an outlet of the duct, for switching an outlet width of the duct with respect to the generating line direction; and a partition, provided in the duct, for partitioning an air passing region inside the duct into a plurality of regions with respect to the generating line direction, wherein the partition extends to a neighborhood of the shutter with respect to an air-blowing direction.

13 Claims, 15 Drawing Sheets

IMAGE HEATING APPARATUS

This is a divisional of U.S. patent application Ser. No. 13/461,133, filed May 1, 2012 pending.

FIELD OF THE INVENTION AND RELATED ART

The present invention relates to an image heating apparatus for heating an image formed on a recording material such as a sheet.

In recent years, in an image forming apparatus, as a fixing type in which an unfixed toner images fixed on the recording material, a fixing device of a film heating type has been put into practical use. In this fixing device of the film heating type, by using a ceramic heater and using a low thermal capacity member as a film, an on-demand type device (apparatus) can be constituted, so that a predetermined fixing temperature can be obtained by supplying electric power to the ceramic heater only during execution of image formation. For that reason, the film heating type has the advantages such that a waiting time from main power on the image forming apparatus until an executable state of the image formation is short (quick start property) and that electric power consumption during stand-by is also remarkably small (electric power saving), and is an excellent heating type with no wastage of energy.

In such a fixing device of the film heating type, in the case where the recording material is fixed in a fixing region, the surface of the film (rotatable heating member) in a sheet passing region has a substantially uniform temperature distribution.

However, in the case where a small-sized recording material smaller in size than a large-sized recording material having a maximum sheet passable width is continuously passed through the fixing device to execute the fixing, there is a possibility that the surface temperature of the rotatable heating member in a non-sheet-passing region (outside a recording material conveyance region) is excessively increased. This is because when the small-sized recording material is continuously passed in a fixing nip, in the non-sheet-passing region in which the recording material is not passed, heat is partly accumulated correspondingly to no heat taken by the recording material. This phenomenon is called as an end portion temperature rise or a non-sheet-passing portion temperature rise of the fixing device. When this end portion T rise reaches a high temperature, it leads to an occurrence of hot offset or a thermal deterioration of device constituent parts.

In order to prevent such a non-sheet-passing portion temperature rise, when the small-sized recording material is continuously passed, it has been known that heat in the non-sheet-passing region increased in temperature during the sheet passing is escaped into a sheet passing region or a fixing device end portion by prolonging a sheet interval (throughput down control) to moderate a temperature gradient. Further, a constitution in which a cooling fan is provided in the fixing device and air is blown onto the rotatable heating member or a pressing member at the non-sheet-passing portion to suppress a temperature rise of the member has been proposed in, e.g., Japanese Laid-Open Patent Application (JP-A) Hei 4-51179, JP-A 2003-076209, JP-A 2007-078984 and JP-A 2008-062031.

In the fixing device of JP-A Hei 4-51179, cooling air is selectively blown from the cooling fan disposed in the fixing device toward the non-sheet-passing region. In the fixing device of JP-A 2003-076209, when cooling air is blown from the cooling fan disposed in the fixing device toward the non-sheet passing region, a length (width) of an air-blowing opening with respect to a widthwise direction is adjusted depending on a size of a recording material used, so that the non-sheet-passing portion temperature rise is prevented also with respect to recording materials having different sizes. In the fixing device of JP-A 2007-078984, cooling air blown from the cooling fan is blown toward a downstream side of the rotatable heating member and thus a blow-out direction of the cooling air and a rotational direction of the rotatable heating member are made opposite to each other, so that a speed of the cooling air relative to that of the rotatable heating member is increased and thereby a cooling efficiency is improved. In the fixing device of JP-A 2008-052031, the cooling fan is made movable integrally with a duct provided with a guide portion for the cooling air and thus the cooling fan and the duct are moved to a predetermined position depending on the recording material size, so that a cooling performance is improved without changing an air-blowing condition also with respect to various recording material sizes.

However, the above-described countermeasure such that the sheet interval is prolonged causes such a problem that productivity is lowered. This throughput down is conspicuous in the fixing device using low thermal capacity heating member and pressing member which meet energy saving, so that there is a possibility that marketability is lowered.

Further, in JP-A Hei 4-51179 and JP-A 2003-076209, an area of the air-blowing opening for guiding the cooling air is changed to meet the recording materials having various sizes with respect to the widthwise direction. In this constitution, a duct shape constituted by the air-blowing opening and the guide portion is changed depending on the respective recording material sizes and therefore there is a possibility that a loss of the volume of the cooling air is caused at a bending portion of the duct or a direction or the like of the cooling air is also changed at the bending portion.

Here, FIG. 16 is a longitudinal sectional front view for illustrating a conventional fixing device during sheet-passing of a small-sized recording material. In FIG. 16, the fixing device includes a fixing member 131, cooling ducts 152L and 152R, cooling fans 153L and 153R and shutters 156L and 156R. For example, in the case where the shutters 156L and 156R are located at positions as shown in FIG. 16, it would be considered that the cooling air runs against a wall surface of the shutter to generate a flow of the air curled or bent in the neighborhood of a movable wall as indicated by a cured arrow (line) Z. In such a case, a flow amount of the air in the neighborhood of the shutter is lost, so that a cooling amount of the non-sheet-passing portion becomes non-uniform with respect to a longitudinal direction.

Further, in JP-A 2007-078984, in order to blow the cooling air toward the downstream side of the rotatable heating member, a duct for setting a direction of the cooling air blown from the cooling fan at one direction is formed. In such a constitution, when an axial fan is used as the cooling fan, it is difficult to set the direction of rotational flow, for continuously pressure-feeding the air by rotation of fins of the cooling fan, at one direction, so that the cooling amount of the non-sheet-passing portion can become non-uniform with respect to the longitudinal direction. This phenomenon was conspicuous particularly in the case where a distance between the cooling fan and a cooling portion such as a heating roller or a pressing roller is short.

Further, in JP-A 2008-052031, in order that the air-blowing condition is not changed with respect to the respective recording material sizes, the cooling fan and the duct are integrally movable. However, in this constitution, a region in which the cooling fan and the duct are movable is required, so that there is a possibility that the fixing device is increased in size.

SUMMARY OF THE INVENTION

The present invention has accomplished in view of the above-described problems. A principal object of the present invention is to provide an image heating apparatus capable of reducing a degree of a lowering in volume (amount) of air blowing by a fan.

According to an aspect of the present invention, there is provided an image heating apparatus comprising: a rotatable fixing member; an air-blowing unit for blowing air onto an end portion of the rotatable fixing member with respect to a generating line direction of the rotatable fixing member, wherein the air-blowing unit includes a fan, a duct for guiding the air generated by drive of the fan, and a shutter, provided at an outlet of the duct, for switching an outlet width of the duct with respect to the generating line direction; and a partition, provided in the duct, for partitioning an air passing region inside the duct into a plurality of regions with respect to the generating line direction, wherein the partition extends to a neighborhood of the shutter with respect to an air-blowing direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, with reference to the drawings, embodiments for carrying out the present invention will be exemplarily described in detail. However, dimensions, materials, shapes and relative configurations of constituent elements described in the following embodiments should be appropriately changed depending on constitutions and various conditions of image heating apparatuses to which the present invention is applied. Therefore, unless otherwise noted specifically, the scope of the present invention is not limited to those in the following embodiments.

[Embodiment 1]

Figure 15:
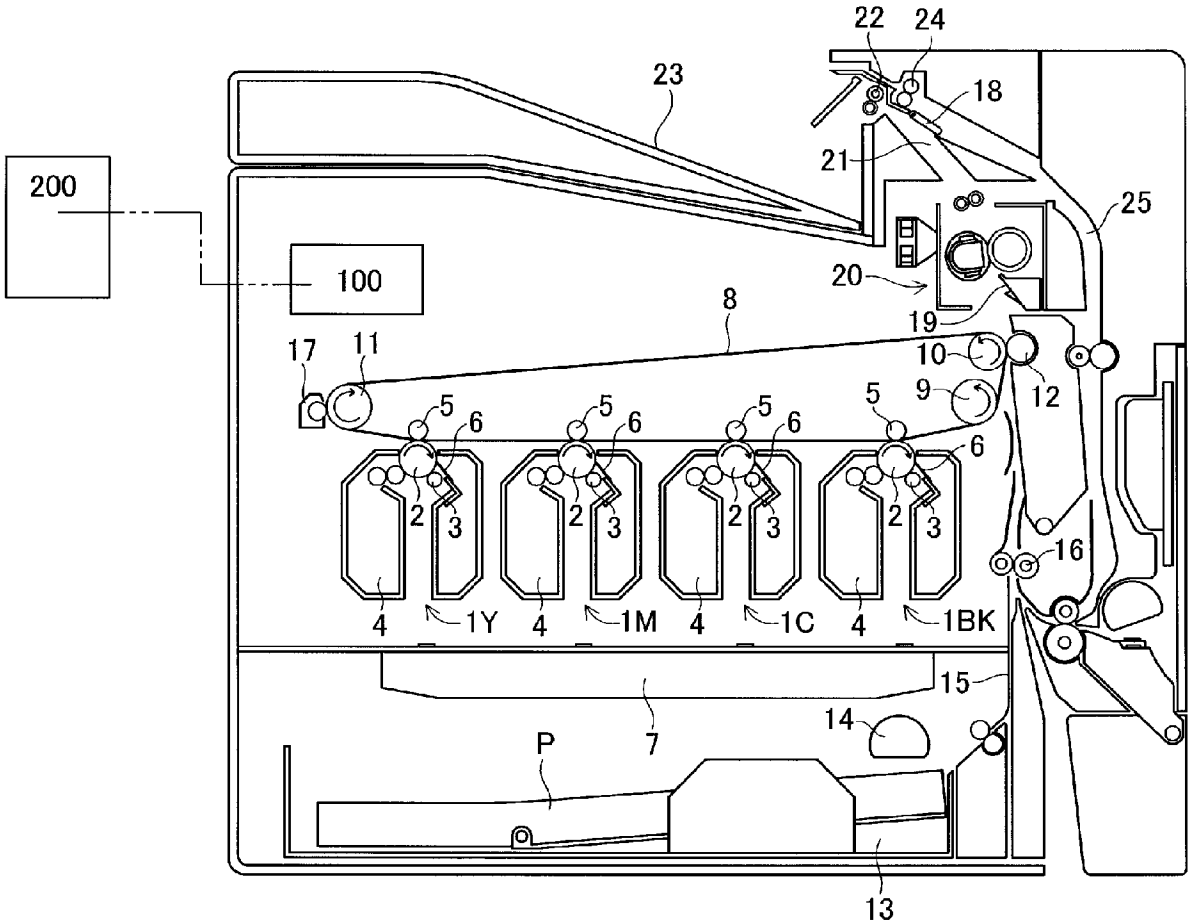
FIG. 15 is a longitudinal sectional view showing a schematic structure of an image forming apparatus in which the fixing device is mounted in Embodiment 1.
Figure 16:
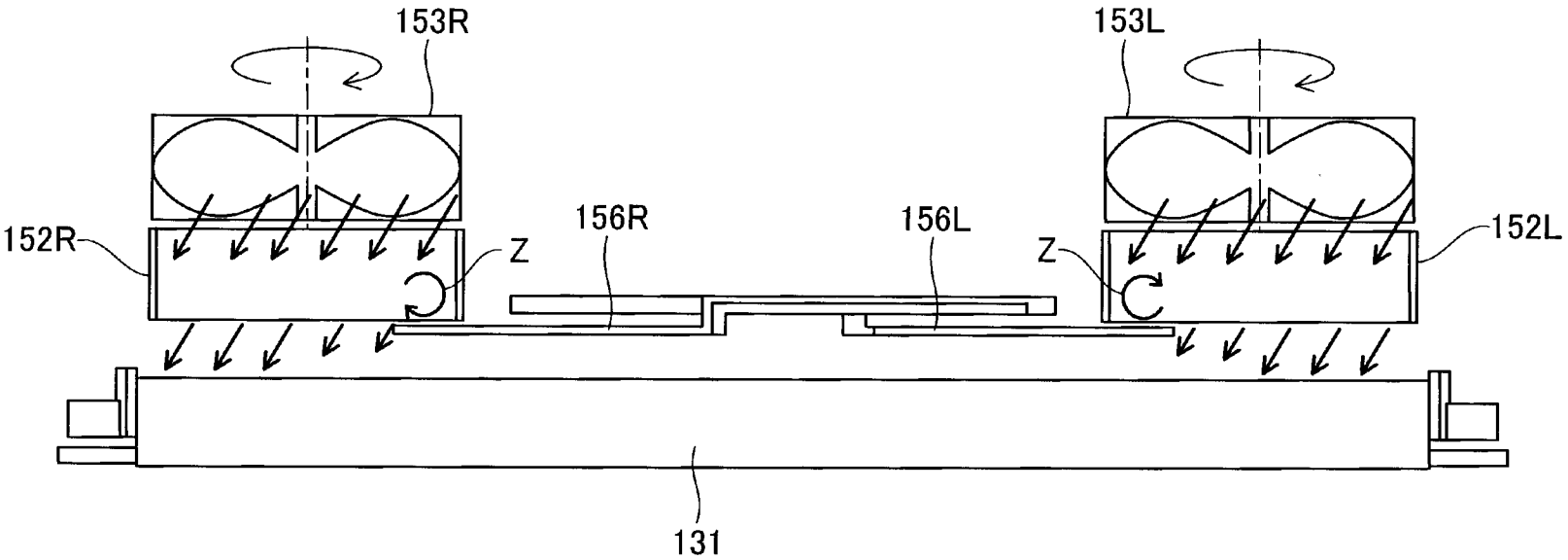
FIG. 16 is a schematic view for illustrating a conventional fixing device during sheet-passing of a small-sized recording material.

FIG. 15 is a longitudinal sectional view showing an electrophotographic full-color printer as an example of an image forming apparatus in which an image heating apparatus according to Embodiment 1 is mounted as a fixing device 20. First, with reference to FIG. 15, a schematic structure of image forming portions will be described.

(Image Forming Portion)

This printer is capable of forming a full-color image on a recording material by performing an image forming operation depending on input image information from an external host device 200 communicatably connected to a control circuit portion (control means: CPU) 100 and then is capable of outputting the recording material.

As the external host device 200, a computer and an image reader can be exemplified. The control circuit portion 100 sends and receives signals with respect to the external host device 200 and also sends and receives signals with respect to various image forming devices, thus managing image forming sequence control.

An endless flexible intermediary transfer belt 8 is stretched among a driving roller 9, a secondary transfer opposite roller 10 and a tension roller 11 and is rotationally driven in the counterclockwise direction indicated by an arrow at a predetermined speed by driving the driving roller 9. A secondary transfer roller 12 is provided so as to be press-contacted to the belt 8 toward the secondary transfer opposite roller 10. A control portion between the belt 8 and the secondary transfer roller 12 constitutes a secondary transfer portion.

First to fourth (four) image forming portions 1Y, 1M, 1C and 1Bk are provided, under the belt 8, in a line with a predetermined interval along a belt movement direction. Each of the image forming portions is an electrophotographic process mechanism of a laser exposure type and includes a drum-type electrophotographic photosensitive member (hereinafter referred to as a drum) 2 as an image bearing member to be rotationally driven in the clockwise direction indicated by an arrow at a predetermined speed. Around the drum 2, a charging roller 3, a developing device 4, a transfer roller 5 as a transfer means and a drum cleaner device 6 are provided.

Each transfer roller 5 is disposed inside the belt 8 and is press-contacted to a lower belt portion of the belt 8 toward the corresponding drum 2. A control portion between each drum 2 and the belt 8 constitutes a primary transfer portion. A laser exposure device 7 for the drums 2 at the respective image forming portions is constituted by a laser light emitting means for emitting laser light corresponding to a time-series electric digital pixel signal of given image information, a polygonal mirror, a reflection mirror and the like.

The control circuit portion 100 causes each image forming portion to perform an image forming operation on the basis of a color-separated component image signal inputted from the external host device 200. As a result, at the first to fourth image forming portions 1Y, 1M, 1C and 1Bk, toner images of yellow, magenta, cyan and black are formed, respectively, on the surfaces of the rotating corresponding drums 2 with predetermined control timing. Incidentally, electrophotographic image forming principle and process for forming the toner images on the drums 2 are well known and therefore will be omitted from description.

The toner images formed on the surfaces of the drums 2 at the respective image forming portions are successively transferred superposedly at the respective primary transfer portions onto the outer surface of the belt 8 rotationally driven in the same direction as the rotational directions of the respective drums 2 at a speed corresponding to rotational speeds of the respective drums 2. As a result, on the surface of the belt 8, an unfixed full-color toner image is synthetically formed by superposition of the above-described four toner images. On the other hand, with predetermined sheet feeding timing, a sheet feeding roller 14 for a sheet feeding cassette 13 in which sheets of a recording material P with one of various width sizes are stacked and accommodated is driven. As a result, one sheet of the sheets of the recording material P stacked and accommodated in the sheet feeding cassette 13 is separated and fed and is passed through a vertical conveying path 15 to be conveyed to registration rollers 16.

The registration rollers 16 convey the recording material P so that a leading end of the recording material P reaches the secondary transfer portion in synchronism with timing when a leading end of the above-described fill-color toner image on the rotating belt 8 reaches the secondary transfer portion. As a result, the toner images for the full-color toner image are collectively secondary-transferred onto the surface of the recording material P.

The recording material P coming out of the secondary transfer portion is separated from the surface of the belt 8 and then is guided by an entrance guide 19 to be introduced into the fixing device 20.

By this fixing device 20, the above-described plurality of the color toner images are melted and mixed and are fixed as a fixed image on the recording material surface. The recording material on which the toner images are fixed by the fixing device 20 is passed through a conveying path 21 and then is sent (discharged) onto a discharge tray 23 through a discharging roller 22.

The surface of the belt after the separation of the recording material at the secondary transfer portion is cleaned by being subjected to removal of residual deposited matter such as a secondary transfer residual toner or the like by a belt cleaning device 17, so that the belt 8 is repeatedly subjected to the image formation.

In the case of an operation in a monochromatic printing mode, control is effected so that only the fourth image forming portion Bk for forming the black toner image performs the image forming operation.

In the case where an operation in a both-side printing mode is selected, control is effected in the following manner. That is, the recording material which has already been subjected to printing on its first surface is sent onto the discharge tray 23 by a switch-back roller 24 through a flapper 18 and then the rotation of the switch-back roller 24 is reversed at the time when a trailing end of the recording material passes through the switch-back roller 24. As a result, the recording material is introduced into a re-conveying path 25 by the switch-back operation. Then, the recording material is conveyed again to the registration rollers 16 in a state in which the recording material is turned upside down. Thereafter, similarly as in the case of the printing on the first surface, the recording material is conveyed through the secondary transfer portion and the fixing device 20 and then is sent as a both-side print image-formed product onto the discharge tray 23.

(Fixing Device)

Next, the fixing device 20 in this embodiment will be described. Incidentally, in the following description, with respect to the fixing device or members constituting the fixing device, a longitudinal direction refers to a direction perpendicular to a recording material conveyance direction in a recording material conveying plane (a plane parallel to an image forming surface (print surface) of the recording material conveyed along the recording material conveying path). With respect to the fixing device, a front surface refers to a surface where the recording material is to be introduced, and left and right refer to those when the fixing device is viewed from the front surface side. A width of the recording material refers to a recording material dimension with respect to the direction perpendicular to the recording material conveyance direction on the image forming surface of the recording material. Further, the longitudinal direction corresponds to a widthwise direction of the recording material (recording material widthwise direction) and also corresponds to a center axis direction of a film 33 (film assembly 31).

Figure 1:
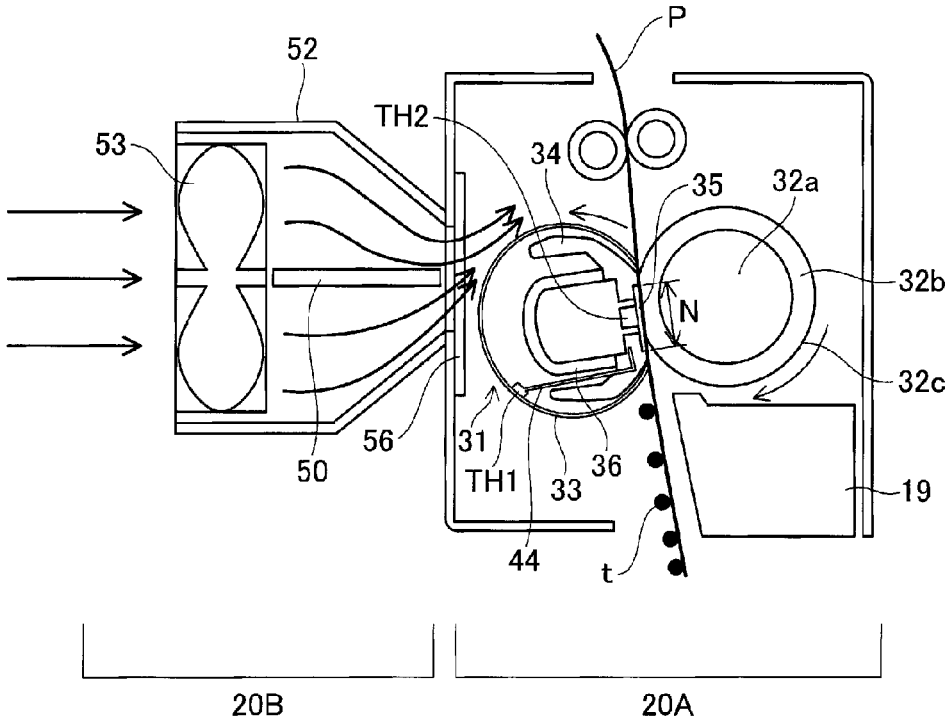
FIG. 1 is a cross-sectional view showing a schematic structure of a fixing device in Embodiment 1.
Figure 2:
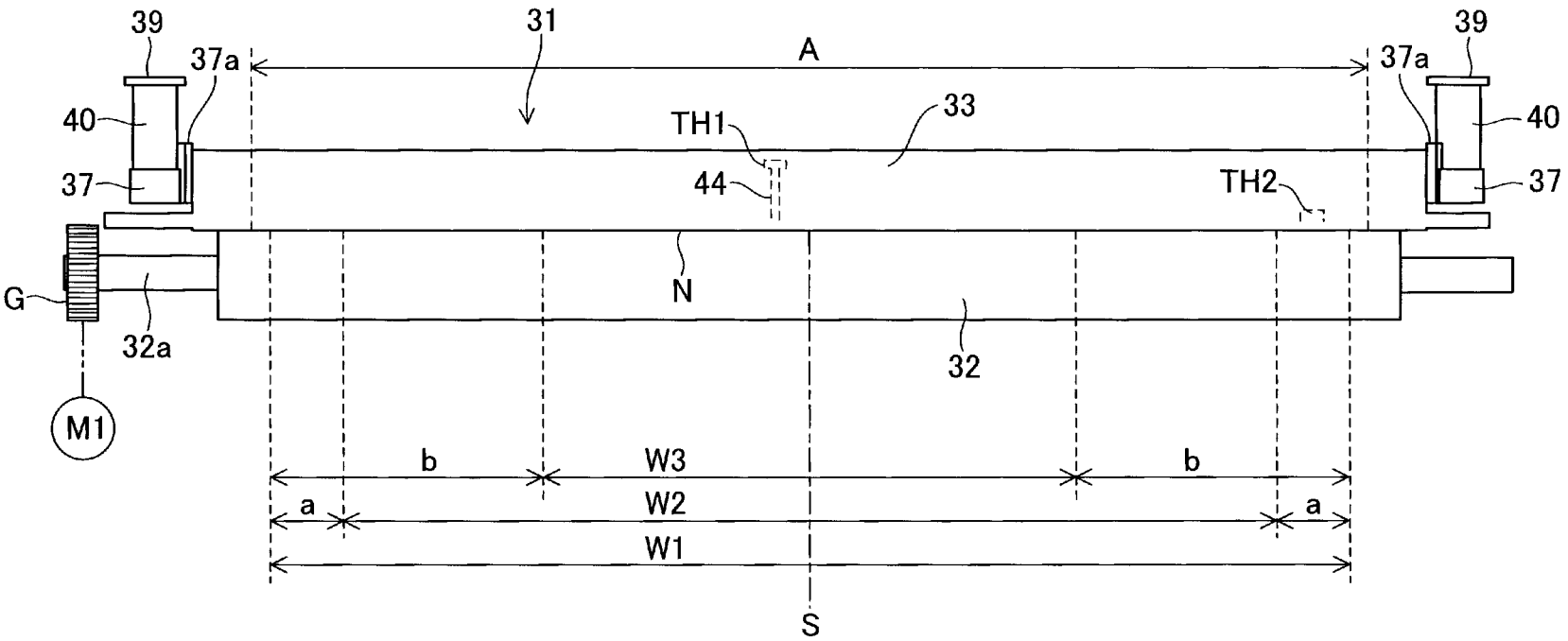
FIG. 2 is a front view showing a schematic structure of a fixing mechanism portion of the fixing device in Embodiment 1.
Figure 3:
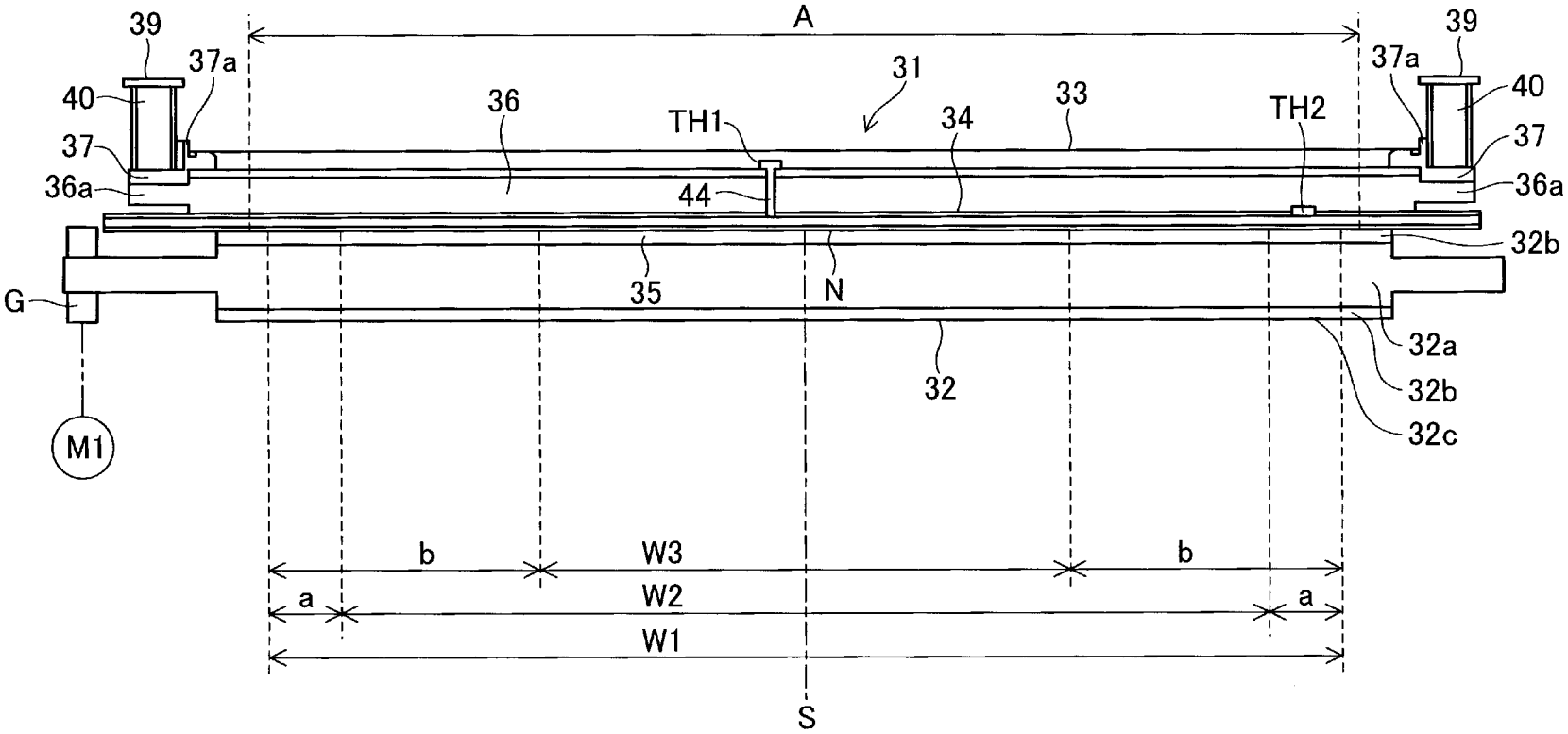
FIG. 3 is a longitudinal sectional front view of the fixing mechanism portion of the fixing device in Embodiment 1.
Figure 4:
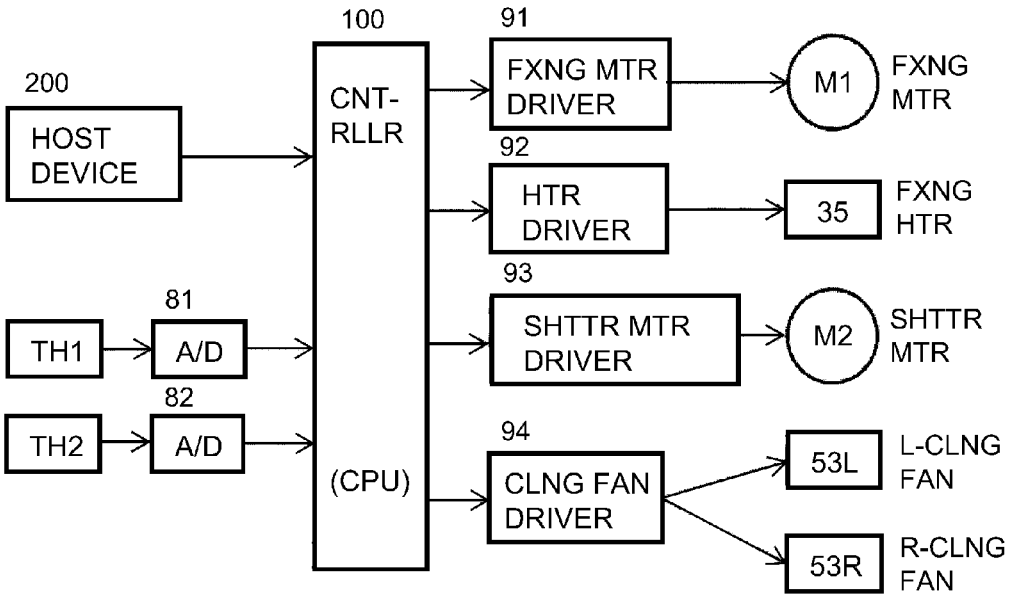
FIG. 4 is a block diagram of a control system of the fixing device in Embodiment 1.

FIG. 1 is a cross-sectional view showing a schematic structure of the fixing device 20 in this embodiment. The fixing device 20 is roughly divided into a fixing mechanism portion (fixing unit portion) 20A of a film (belt) heating type and an air-blowing cooling mechanism portion (air-blowing cooling unit portion) 20B. FIG. 2 is a front view showing a schematic structure of the fixing mechanism portion 20A, and FIG. 3 is a longitudinal sectional front view of the fixing mechanism portion 20A. FIG. 4 is a block diagram of a control system of the fixing device 20.

(Fixing Mechanism Portion)

First, the schematic structure of the fixing mechanism portion 20A will be described.

The fixing mechanism portion 20A is basically an on-demand fixing device of a belt (film) heating type and a rotatable pressing member drive type. The fixing mechanism portion 20A includes the film assembly (fixing unit) 31 and an elastic pressing roller 32 as a nip-forming member. A fixing nip N is formed by press-contact of these members 31 and 32. In the fixing device 20, in this fixing nip N, the recording material is conveyed while being nipped and at the same time, the image formed on the recording material is heated by the film assembly 31.

The film assembly 31 includes a fixing film 33, as a rotatable heating member, which has a cylindrical shape (endless belt shape or sleeve shape) and has flexibility, a film guide 34 (functioning as a heat holding member and a film guide member) which has a substantially arcuate tub-like shape in cross section and has a heat-resistant property and a rigidity, and a ceramic heater 35 as a heating source (heating member). The heater 35 is fixed by being engaged in a recessed groove portion provided on the outer surface of the film guide 34 along the longitudinal direction of the film guide 34.

The film 33 is externally engaged loosely with the film guide 34 on which the heater 35 is mounted. A pressing stay 36 which has a U-shape in cross section and has a rigidity is provided inside the film guide 34. An end portion holder 37 is engaged with an outwardly projected arm portion 36*a* provided at each of left and right end portions of the pressing stay 36. A flange portion 37*a* is provided integrally with the end portion holder 37. The film 33 is a composite layer structure formed by adding an elastic layer, a parting layer and the like on the outer peripheral surface of a base layer consisting of a heat-resistant resin belt or a metal belt, and is member which is thin as a whole and has a flexibility, a high thermal conductivity and a low thermal capacity.

The heater 35 is an elongated thin linear heating member which is extended in the longitudinal direction and has a low thermal capacity. The heater 35 is has a basic structure including a heater substrate of a ceramic material such as aluminum nitride or alumina and an energization heat-generating layer formed of silver-palladium or the like on the heater substrate. The ceramic heater is well known in various types and therefore will be omitted from detailed description.

The pressing roller 32 is formed in a predetermined hardness by providing, on the outer peripheral surface of a core metal 32*a*, an elastic layer 32*b* of a silicone rubber or the like. In order to improve non-adhesiveness, on the outer peripheral surface of the elastic layer 32*b*, a fluorine-containing resin layer 32*c* of PTFE, PFA, FEP or the like may also be provided. The pressing roller 32 is provided, as a pressing member, rotatably shaft-supported via bearing members between left and right side plates of a device frame (not shown) at left and right end portions of its core metal 32*a*.

The film assembly 31 is disposed in parallel to the pressing roller 32 so that the heater 35 is close to and opposed to the pressing roller 32. Between the left (right) end portion holder 37 and a left (right) fixed spring receiving member 39, a pressing (urging) spring 40 is compressedly provided. As a result, the pressing stay 36, the film guide 34 and the heater 35 is pressed and urged toward the pressing roller 32. By this pressing (urging) force, the surface of the heater 35 is pressed onto the film 33 toward the pressing roller 32 against elasticity of the elastic layer 32*b*, so that the film 33 and the pressing roller 32 are placed in a press-contact state to form the fixing nip N, with a predetermined width with respect to the recording material conveyance direction, required for heat-fixing.

A drive gear G shown in FIG. 2 is fixed at the left end portion of the core metal 32*a* of the pressing roller 32. To this gear G, a rotational force of a fixing motor M is transmitted via an unshown power transmitting mechanism, so that the pressing roller 32 is rotationally driven in the clockwise direction indicated by an arrow in FIG. 1. By this rotational drive of the pressing roller 32, a rotational force acts on the film 33 due to a frictional force in the fixing nip N between the surface of the pressing roller 32 and the outer surface of the film 33. As a result, the film 33 rotates around the film guide 34 in the counterclockwise direction indicated by an arrow while sliding on and in close contact to the heater in the fixing nip N at its inner surface (pressing roller drive type). The film 33 rotates at a peripheral speed substantially corresponding to the rotational peripheral speed of the pressing roller 32.

The left and right flange portions 37*a* perform the function of preventing movement of the belt (film), when the film 33 is laterally moved leftward or rightward along the longitudinal direction of the film guide 34, by receiving the laterally moved belt (film) end portion. Onto the inner surface of the film 33, grease (lubricant) is applied, so that a sliding property of the film 33 on the film guide 34 is ensured.

The recording material P introduced into the fixing nip N by being guided by the entrance guide 19 is nip-conveyed by the pressing roller 32 and the film 33 which are rotated. In this embodiment, the conveyance of the recording material P is carried out on the basis of a center (line) of the width of the recording material, i.e., by so-called center (line)-based conveyance. That is, the recording material having any width usable by being passed through the fixing device passes through the fixing nip N so that a central portion of the recording material with respect to the widthwise direction passes through a central portion of the film 33 with respect to the longitudinal direction. In FIG. 2, S represents a recording material passing center reference line (phantom line).

W1 represents a sheet passing width (maximum sheet passing width) of a maximum width recording material passable through the fixing device. In this embodiment, the maximum sheet passing width W1 is an A3 portrait size width of 297 mm (A3 portrait feeding). An effective heat generating region width A of the heater with respect to the longitudinal direction is set at a value somewhat larger than the maximum sheet passing width W1.

W3 represents a sheet passing width (minimum sheet passing width) of a minimum recording material passable through the fixing device. In this embodiment, the minimum sheet passing width W3 is an A5 portrait size width of 148 mm (A5 portrait feeding).

W2 represents a sheet passing width of a recording material having a width between those of the maximum width recording material and the minimum width recording material. In this embodiment, the sheet passing width W2 is a B4 portrait size width of 257 mm (B4 portrait feeding). Hereinbelow, the recording material having a width corresponding to the maximum sheet passing width W1 is referred to a maximum-sized recording material, and the recording material having a size smaller than that of the maximum-sized recording material is referred to as a small-sized recording material.

In FIG. 2, a represents a difference width portion ((W1-W2)/2) between the maximum sheet passing width W1 and the sheet passing width W2, and b represents a difference width portion ((W1-W3/2) between the maximum sheet passing width W1 and the minimum sheet passing width W3. That is, non-sheet-passing portions a and b are generated when a B4-sized recording material and an A4-sized recording material which are the small-sized recording material are passed, respectively. Thus, the non-sheet-passing portion is a part of the region of the film 33 and with respect to the longitudinal direction, corresponds to a non-passing region of the recording material (outside a recording material passing region (recording material conveyance region)) in the case where the recording material having a width narrower than that of the maximum-sized recording material conveyable through the fixing nip N is conveyed through the fixing nip N.

In this embodiment, the sheet passing of the recording material is effected by the center-based conveyance and therefore the non-sheet-passing portions a and b are generated at each of left and right side portions of the sheet passing width W2 and each of left and right side portions of the minimum sheet passing width W3, respectively, as shown in FIG. 2. This width of the non-sheet-passing portion varies depending on the width of the small-sized recording material used.

Two thermistors TH1 and TH2 are a main thermistor and a sub-thermistor as first and second temperature detecting means (temperature detecting elements), respectively. The main thermistor TH1 is provided in elastical contact to the inner surface of the film 33 so as to detect the temperature of a film portion corresponding to the sheet passing position of the recording material having any width. Specifically, the thermistor TH1 is supported at a free end portion of an elastic supporting member 44 which has a base portion fixed on the film guide 34 and has a leaf spring shape. Further, the thermistor TH1 is disposed so as to be elastically contacted to the inner surface of the film 33 by elasticity of the elastic supporting member 44.

The sub-thermistor TH2 is provided in contact to a back surface of the heater so as to detect the temperature of a heater portion corresponding to the non-sheet-passing portion when the recording material having the width smaller than that of the maximum-sized recording material passable through the fixing device is passed through the fixing device.

Incidentally, the main thermistor TH1 may also be disposed so as to detect the heater temperature at a portion corresponding to the portion of the minimum sheet passing width W3. On the other hand, the sub-thermistor TH2 may also be disposed in elastical contact to the inner surface of the base layer of the film portion corresponding to the non-sheet-passing portion a.

The heater 35 is quickly increased in temperature in a whole effective heat generating width region with respect to the longitudinal direction by supplying electric power from a heater drive circuit (FIG. 4) as an electric power supply portion to the energization heat generating layer provided at the heater substrate surface. The temperature of the film 33 is detected by the main thermistor TH1 and then electrical information on the film temperature is inputted into the control circuit portion 100 via an A/D converter 81. Further, the heater temperature is detected by the sub-thermistor TH2 and then electrical information on the heater temperature is inputted into the control circuit portion 100 via an A/D converter 82.

The control circuit portion 100 controls a fixing motor driving circuit 91 on the basis of a print signal from the external host device 200 or another control signal, thus driving the fixing motor M1. As a result, the pressing roller 32 is rotationally driven, and the film is also rotated. Further, the control circuit portion 100 controls a heater driving circuit 92 to start heat-up of the heater 35.

In a state in which the rotational speed of the film 33 is steadied and the temperature of the heater 35 is increased up to a predetermined temperature, the recording material P carrying thereon the unfixed toner image t is guided along the entrance guide 19 and is introduced from the image forming portion into the fixing nip N. At this time, a toner image carrying surface of the recording material P faces (opposes) the film 33.

The recording material P is closely contacted to the film 33 toward the heater 35 in the fixing nip N and is passed through the fixing nip N together with the film 33. In the movement passing process, heat is applied to the recording material P by the film 33 heated by the heater 35 and a fixing nip pressure is applied to the recording material P, so that the toner image t is fixed on the surface of the recording material P under application of the heat and the pressure. The recording material P passing through the fixing nip N is separated from the surface of the film 33 and then is conveyed to be discharged.

(Air-Blowing Cooling Mechanism Portion)

The air-blowing cooling mechanism portion 20B is an air-blowing cooling means for cooling, by the air-blowing, a non-sheet-passing region in the fixing mechanism portion 20A generated when sheets of the small-sized recording material having a width narrower than the maximum width of the recording material passed and usable in the image forming apparatus are continuously passed through the fixing device.

In this embodiment, as shown in FIG. 1, a cooling fan 53 as an air-blowing means and a cooling duct 52 for guiding the air (wind) from the cooling fan 53 onto the non-sheet-passing region are provided close to a downstream side of the film 33 with respect to the recording material conveyance direction, and inside the cooling duct 52, a horizontal partition 50 perpendicular to the recording material conveyance direction is provided. As a result, a direction of the air is set so that the cooling air is blown toward the downstream side with respect to the recording material conveyance direction. Incidentally, in the following description, the cooling fan 53 and the like are described in some cases by adding suffixes L and R thereto for representing the left and right but in the case where there is no need to differentiate particularly the left and right, the suffixes L and R will be omitted.

Figure 5:
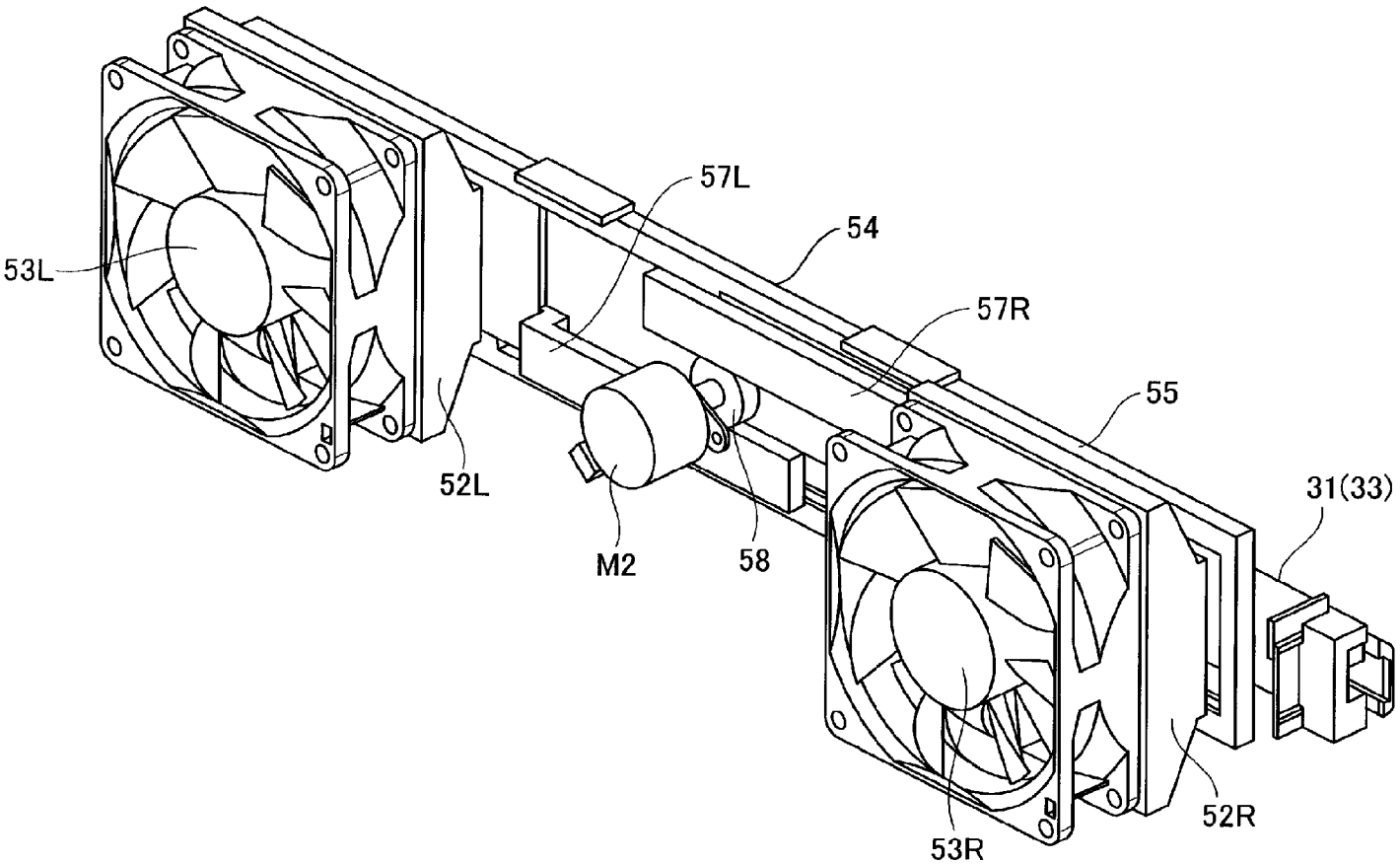
FIGS. 5 and 6 are perspective views each showing an outer appearance of an air-blowing cooling unit of the fixing device in Embodiment 1.
Figure 6:
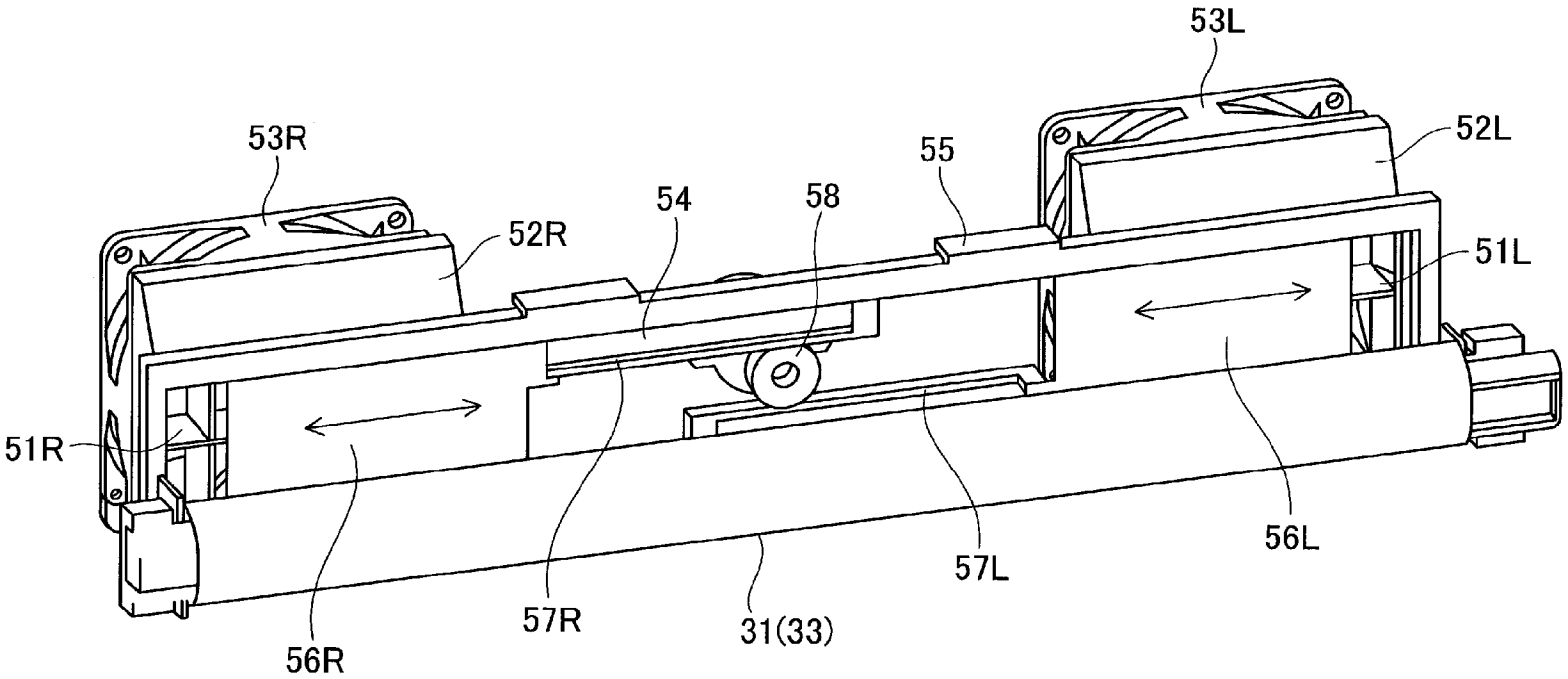
Figure 7:
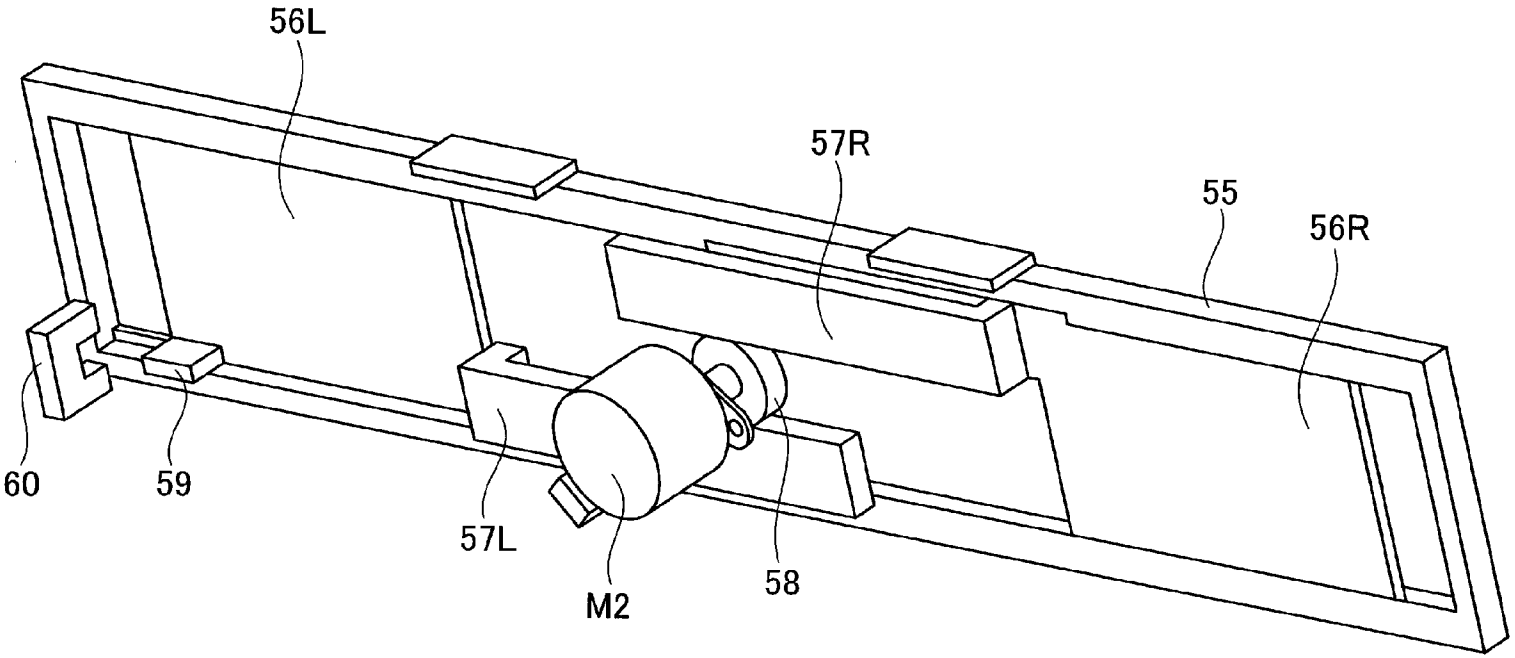
FIG. 7 is a perspective view showing an outer appearance of a shutter mechanism portion in Embodiment 1.
Figure 8:
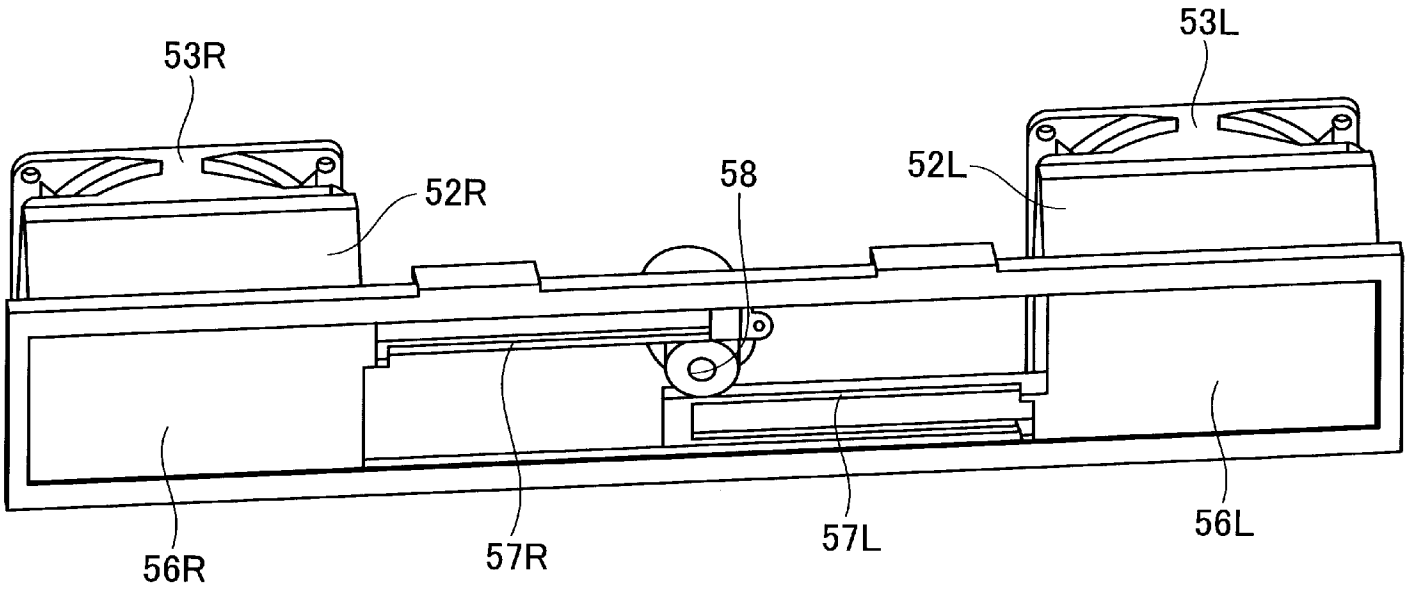
FIG. 8 is a schematic view showing a state in which a shutter is moved to a full-close position in Embodiment 1.
Figure 9:
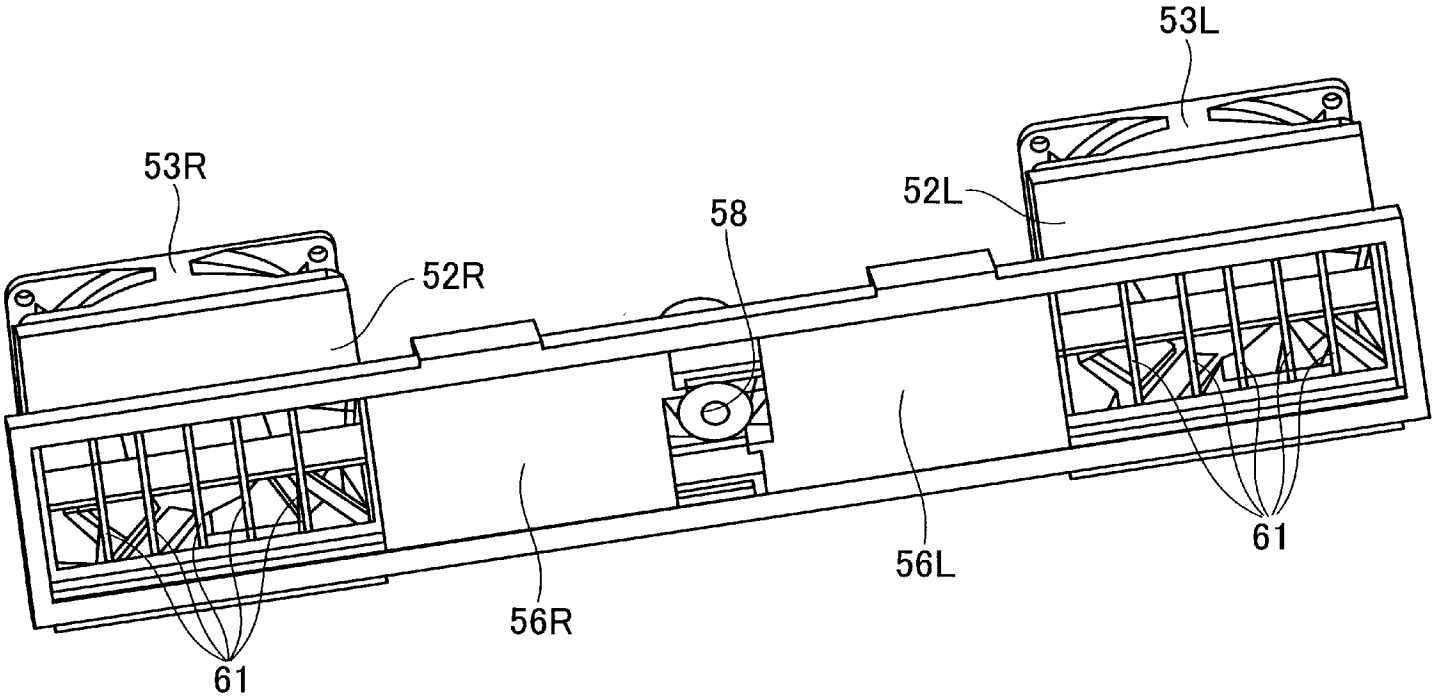
FIG. 9 is a schematic view showing a state in which the shutter is moved to a full-open position in Embodiment 1.

FIGS. 5 and 6 are perspective views each showing an outer appearance of the air-blowing cooling mechanism portion 20B as seen in a different direction. However, in each of FIGS. 5 and 6, the film assembly 31 is a constituent member of the above-described fixing mechanism portion 20A. FIG. 7 is a perspective view showing an outer appearance of a shutter mechanism portion. FIG. 8 is a schematic view showing a state in which a shutter 56 as an opening changing member is moved to a full-close position where the shutter 56 completely closes an air-blowing opening. FIG. 9 is a schematic view showing a state in which the shutter 56 is moved to a full-open position where the shutter 56 completely opens the air-blowing opening.

With respect to the position of the cooling fans 53, at the fixing mechanism portion 20A side, a pair of left and right cooling ducts 52L and 52R is provided. Each of the cooling ducts 52L and 52R is provided with an opening (duct entrance) where the cooling fan 53L (or 53R) is provided, and the other end side (duct outlet), opposite from the opening where the cooling fan 53 is provided, is open as the air-blowing opening. The other end side is a downstream side of an air-blowing path (wind path, air path) by the cooling fan 53 with respect to an air-blowing direction and is a side close to the fixing mechanism portion 20A.

The left and right cooling ducts 52L and 52R have the same shape or a symmetrical shape with respect to the center reference line S (the center line of the film 33 with respect to the longitudinal direction). The cooling ducts 52L and 52R are disposed so that their axes are substantially perpendicular to the rotational axis of the film 33. Further, inside each of the cooling ducts 52L and 52R, a plurality of partitions 61 each extending substantially in parallel to the recording material conveyance direction are provided with a pitch of 10 mm to 15 mm. Here, the partitions 61 correspond to partition walls for partitioning an inside space of each cooling duct so that the air paths of the air from the cooling fan 53 are arranged in the longitudinal direction.

When the left and right cooling fans 53L and 53R are turned on, the air is sucked from an unshown air suction duct in the image forming apparatus main assembly, and then the cooling air is blown into the left and right cooling ducts 52L and 52R to be blown through the air-blowing openings. In this embodiment, as the cooling fans 53L and 53R, an axial fan is used.

At the other end side (close to the fixing mechanism portion 20) of the left and right cooling ducts 52L and 52R of the air-blowing cooling mechanism portion 20B, a shutter mechanism (shutter unit) 54 as an opening width adjusting means is provided. This shutter mechanism 54 is disposed so that its outer surface (close to the fixing mechanism portion 20A) is close to and opposes the film assembly 31 of the fixing mechanism portion 20A. The shutter mechanism 54 includes a shutter frame 55 extending in the longitudinal direction which is a left-right direction. The shutter frame 55 is provided with air-blowing openings 51L and 51R at its left and right portions, respectively. The left and right cooling ducts 52L and 52R are provided with air blowout openings so as to correspond to (substantially coincide with) the left and right air-blowing openings 51L and 51R. Here, the air-blowing openings 51L and 51R of the shutter frame 55 and the air blowout openings of the cooling ducts 52L and 52R constitute duct air-blowing openings. These duct air-blowing openings are to be provided opposed to the non-sheet-passing regions of the film 33.

Further, the shutter frame 55 is provided with a shutter (shutter plate) 56L capable of changing the opening width of the left air-blowing opening 51L and a shutter 56R for adjusting the opening width of the right air-blowing opening 56R. Each of the left and right shutters 56L and 56R is held by the shutter frame 55 so as to be slidably movable to the left-right direction along the air-blowing opening as indicated by an arrow. Further, the shutter frame 55 is provided with left and right racks 57L and 57R and a pinion gear 58 for moving the left and right shutters 56L and 56R in interrelation with each other. The left rack 57L is formed integrally with the left shutter 56L, and the right rack 57R is formed integrally with the right shutter 56R. The pinion gear 58 is engaged with the left and right racks 57L and 57R.

The pinion gear 58 is driven normally or reversely by a shutter motor (pulse motor) M2 provided on an unshown main assembly frame. The pinion gear 58 is driven normally or reversely, so that the left and right shutters 56L and 56R are reciprocated (opened or closed reactive to the air-blowing openings) with the same movement amount (distance) in an approaching direction or a spacing direction in interrelation with each other. As a result, the opening widths of the left and right air-blowing openings 51L and 51R of the shutter mechanism 54 are adjusted so as to be broaden and narrowed in the same manner with respect to the left-right direction.

The control circuit portion 100 controls a shutter motor driving circuit 93 when the recording material width information is a large-sized recording material having an A3-size width, so that the shutters 56 are moved to the full-close positions where the air blowout openings are completely closed with the shutters as shown in FIG. 8. Further, when the recording material width information is a small-sized recording material having an A5R-size width, the shutters 56 are moved to the full-close positions where the air blowout openings are completely opened by the shutters as shown in FIG. 9. Further, when the recording material width information is a small-sized recording material having a B4-size width, the shutters 56 are moved to positions where the air blowout openings are opened corresponding to the non-sheet-passing portions a (FIGS. 2 and 3).

Here, in the case where the small-sized recording material to be passed through the fixing device has a size of LCT-R, EXE, LTR or the like, the control circuit portion 100 moves the shutters 56 to positions where the air blowout openings (air-blowing openings) are opened corresponding to the non-sheet-passing portions generated in the associated case.

That is, each shutter 56 is provided so as to be capable of adjusting the opening width (air-blowing width) of the air blowout opening (air-blowing opening) depending on the width (longitudinal length) of the recording material. Incidentally, the minimum and maximum sheet sizes and other all sheet sizes (various sizes) which are referred to in this embodiment are those for regular papers (sheets) assured by the image forming apparatus main assembly and do not refer to irregular(-sized) papers which are used independently by a user.

Positional information of the shutter 56 is obtained by detecting a flag 59, provided at a predetermined position of the shutter 56, by a sensor 60 provided on the unshown main assembly frame. Specifically, the shutter position where the air blowout opening is completely closed is determined as a home position, and an amount of the opening is detected from an amount of the rotation of the shutter motor M2.

Incidentally, a constitution in which an opening width detecting sensor for directly detecting a current position of the shutter 56 is provided and a shutter position information obtained by the sensor is fed back to the control circuit portion 100 and then the shutter 56 is controlled to be moved to a proper opening width position corresponding to the width of the recording material to be passed through the fixing device may also be employed. A shutter stop position is determined with accuracy as a position corresponding to the length of the recording material with respect to the widthwise direction by detecting a shutter edge position by the sensor. Therefore, the cooling air can be blown onto only the non-sheet-passing region of each of all the small-sized recording materials.

Figure 10:
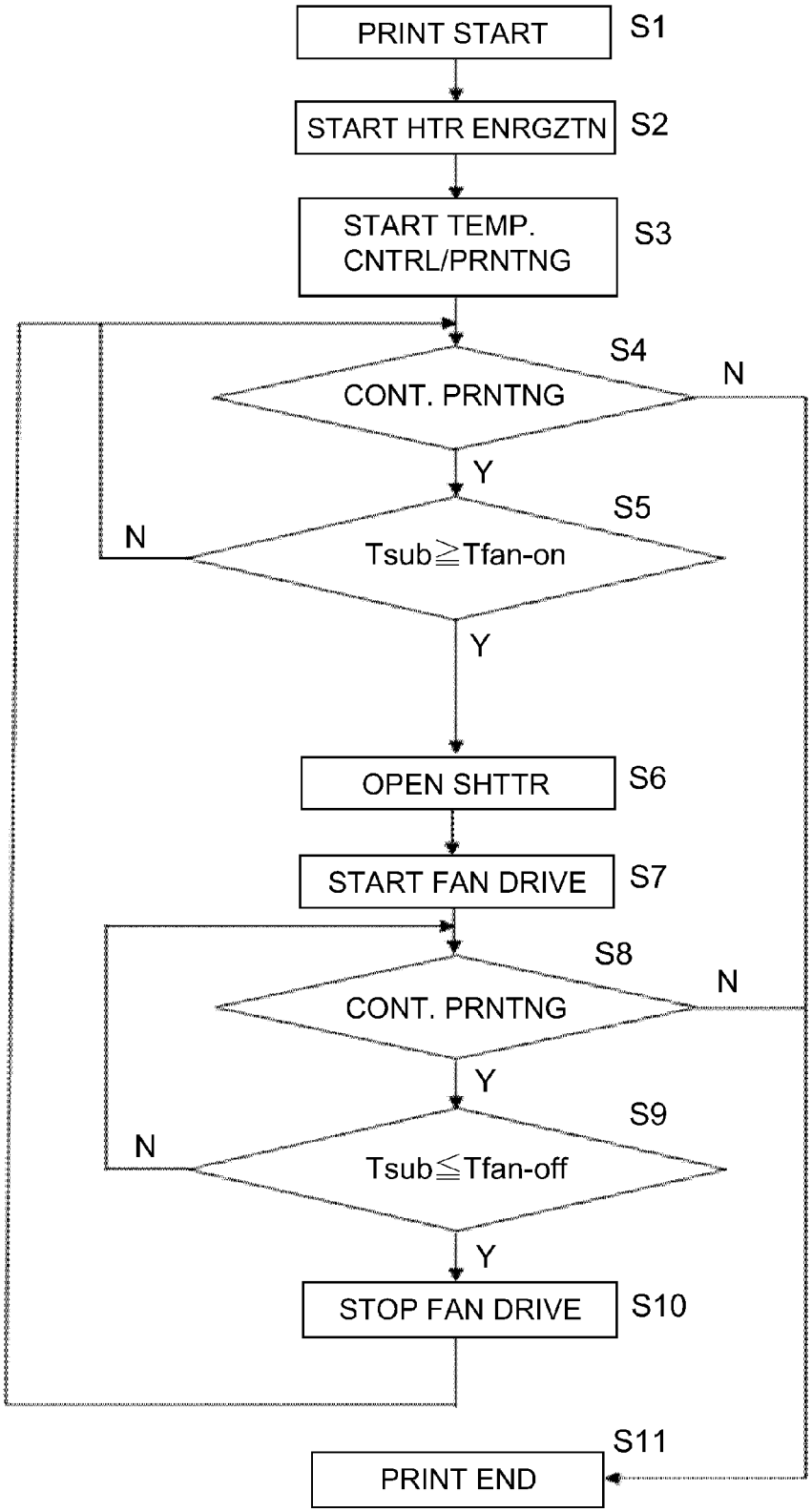
FIG. 10 is a flow chart showing control of a cooling fan of the fixing device in Embodiment 1.

Next, an operation of the left and right cooling fans 53L and 53R in the fixing device in this embodiment will be described by using a flow chart of FIG. 10. Operation control of the cooling fans 53L and 53R is effected by controlling a cooling fan driving circuit 94 by the control circuit portion 100.

When a print start signal is received (step S1), energization to the heater 35 is started (step S29, so that a temperature rising operation of the fixing device is started. When the temperature of the fixing device reaches a predetermined temperature, temperature control and a printing operation (print) are started so that the temperature of the main thermistor TH1 reaches a predetermined fixing temperature (step S3).

Thereafter, in the case where the print is not continued (N (No) of step S4), the print is ended (step S11). On the other hand, in the case where the print is continued (Y (Yes) of step S4), when a detected temperature Tsub by the sub-thermistor TH2 is not less than a cooling fan driving temperature Tfan-on (Y (Yes) of step S5), the shutter 56 is opened on the basis of the recording material width (step S6). Thereafter, drive of the cooling fan 53 is started (step S7).

In the case where the print is further continued (Y (Yes) of step S8), the non-sheet-passing region is cooled by the cooling fan 53. Thereafter, when the detected temperature Tsub by the sub-thermistor TH2 is not more than a cooling fan driving temperature Tfan-off (Y (Yes) of step S9), the drive of the cooling fan 53 is stopped (step S10) and then the operation is returned to the step S4. Incidentally, in the step S8, in the case where the print is not continued (N (No) of step S8), the print is ended (step S11).

Figure 11:
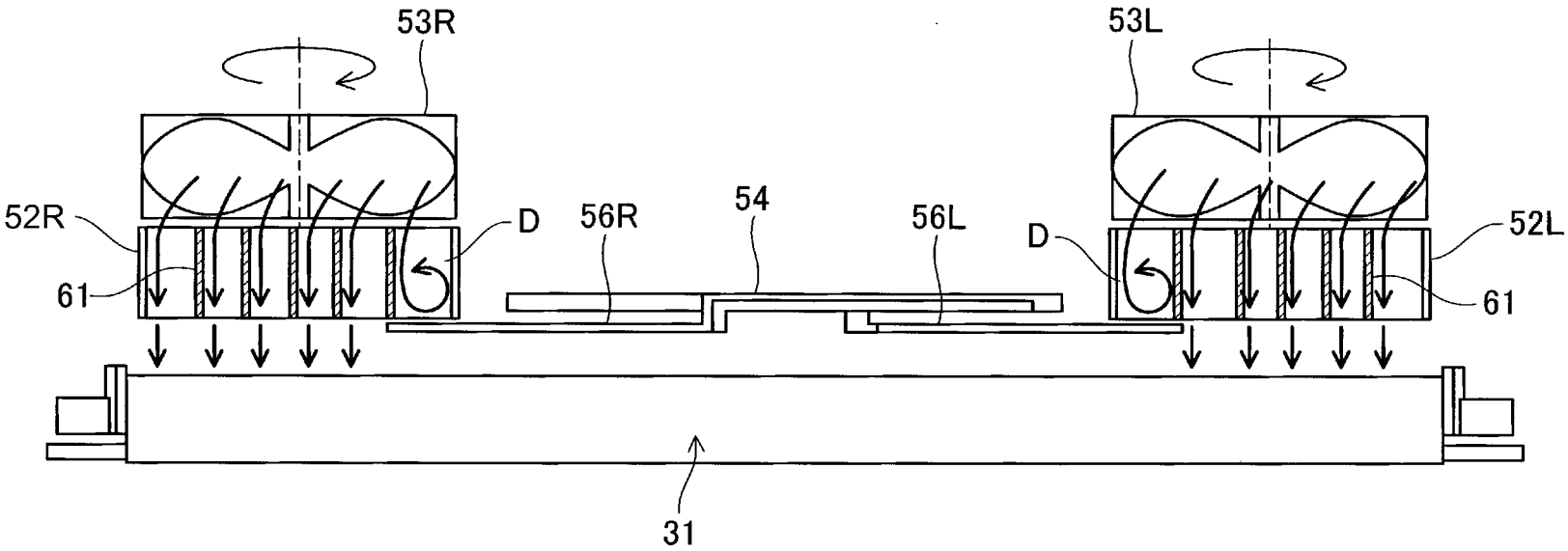
FIG. 11 is a cross-sectional front view showing an air-blowing cooling mechanism portion in Embodiment 1.

FIG. 11 is a cross-sectional front view showing the air-blowing cooling mechanism portion 20B.

In this embodiment, as shown in FIG. 11, the plurality of partitions 61 each extending in a front-rear direction substantially parallel to the recording material conveyance direction are provided with the pitch of 10 mm to 15 mm with respect to the longitudinal direction. As a result, the direction of a rotational flow generated by the rotation of the fins of the cooling fan 53 can be set at one direction along the partitions.

Here, in the case where the shutter mechanism 54 is disposed at the opening side of the cooling duct (at the upstream side of the cooling fan 53 with respect to the air-blowing path direction, there is the following possibility. That is, the cooling air generated by the cooling fan 53 immediately runs against the shutter 56 and thus the cooling fan 53 is subjected to rotational load, so that the number of rotations of the cooling fan 53 is lowered.

On the other hand, in this embodiment, the shutter mechanism 54 for adjusting the opening width of the cooling duct 52 is disposed at the other end side (close to the fixing mechanism portion 20A) of the air blowout opening of the cooling duct 52. By employing such a constitution, a distance between the cooling fan 53 and the shutter 56 can be increased, so that the cooling air generated by the cooling fan 53 is prevented from immediately running against the shutter 56 and thus the cooling air can be escaped into a partly closed space D defined by the partition 61 and the shutter 56. As a result, compared with the case where the shutter mechanism 54 is disposed at the opening side of the cooling duct 52, the rotation load exerted on the cooling fan 53 can be suppressed, so that it is possible to prevent a lowering in the number of rotations of the cooling fan 53.

As described above, in this embodiment, in the cooling device for cooling the non-sheet-passing portion of the fixing mechanism portion 20A, inside (at the inner portion of) the cooling duct 52 for setting the direction of the cooling air blown from the cooling fan 53 at one direction, the partitions 61 extending substantially in parallel to the recording material conveyance direction are disposed.

By employing such a constitution, the direction of the rotation flow generated by the rotation of the fins of the axial fan constituting the cooling fan 53 can be set at one direction without lowering the volume of the cooling air. As a result, the amount of cooling of the non-sheet-passing portion can be made uniform with respect to the longitudinal direction.

Further, the shutter 56 for adjusting the opening width of the cooling duct 52 is provided at the other end side (close to the fixing mechanism portion 20A) of the air blowout opening of the cooling duct 52. By employing such a constitution, the distance between the shutter 56 and the cooling fan 53 can be increased by the presence of the partitions 61 inside the cooling duct 52, so that it become possible to provide a place, where the air can be escaped, between the cooling fan 53 and the wall of the shutter 56. For that reason, the rotational load on the cooling fan 53 by the shutter 56 is alleviated, so that the influence of the lowering in air volume when the shutter 56 is closed can be prevented (eliminated).

Therefore, temperature non-uniformity in the sheet passing region and excessive temperature rise in the non-sheet-passing region can be eliminated, so that it becomes possible to prevent the conveyance speed down and the fixing non-uniformity such as uneven glossiness of the image with respect to the small-sized recording material.

Incidentally, in this embodiment, the case where the partitions 61 are disposed substantially in parallel to the recording material conveyance direction, i.e., the case where the direction of the air blown along the partitions 61 is set at the direction parallel to the surface perpendicular to the center axis of the film 33 is described but the present invention is not limited thereto. The partitions 61 may also be disposed so that the direction of the air blown along the partitions 61 is set at one direction in which the direction is apart from the sheet passing region (the recording material passing region, which is a part of the region of the film 33, in the case where the recording material is conveyed). That is, the partitions 61 may only be required that the direction of the air blown from the cooling fan 53 along the partitions 61 is directed toward the sheet passing region.

[Embodiment 2]

Embodiment 2 will be described below.

Figure 12:
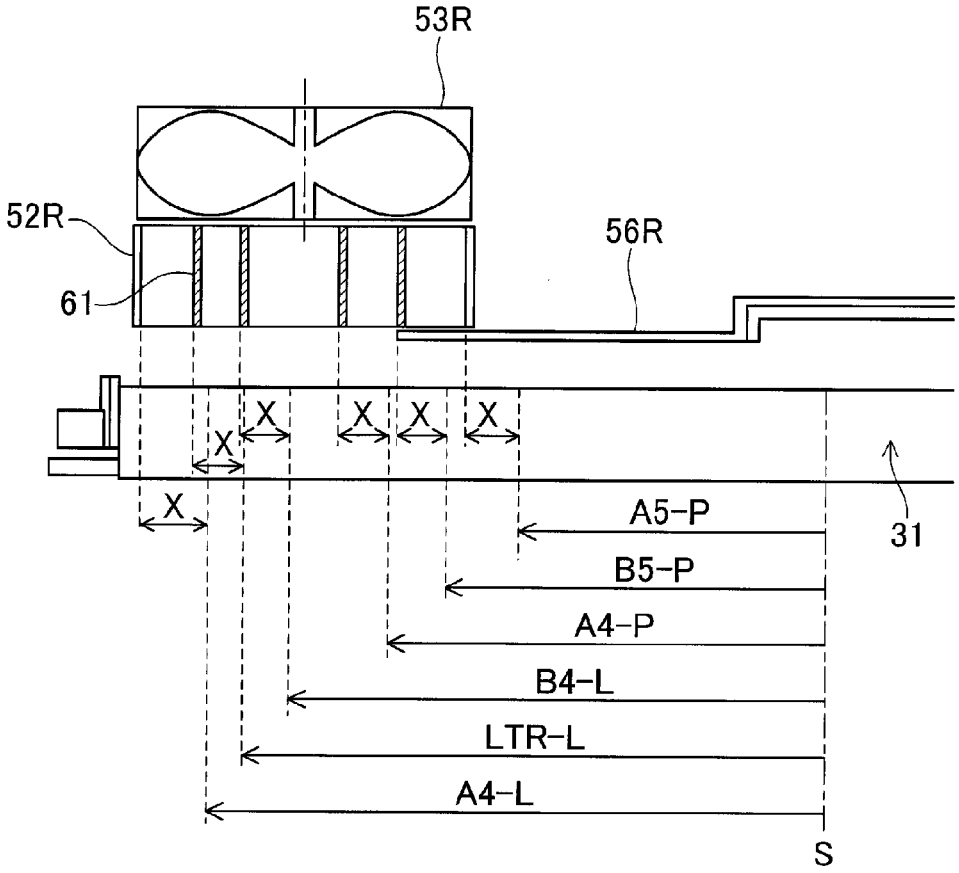
FIG. 12 is a schematic view for illustrating a positional relation between regular papers and partitions in a cooling duct in Embodiment 2.
Figure 13:
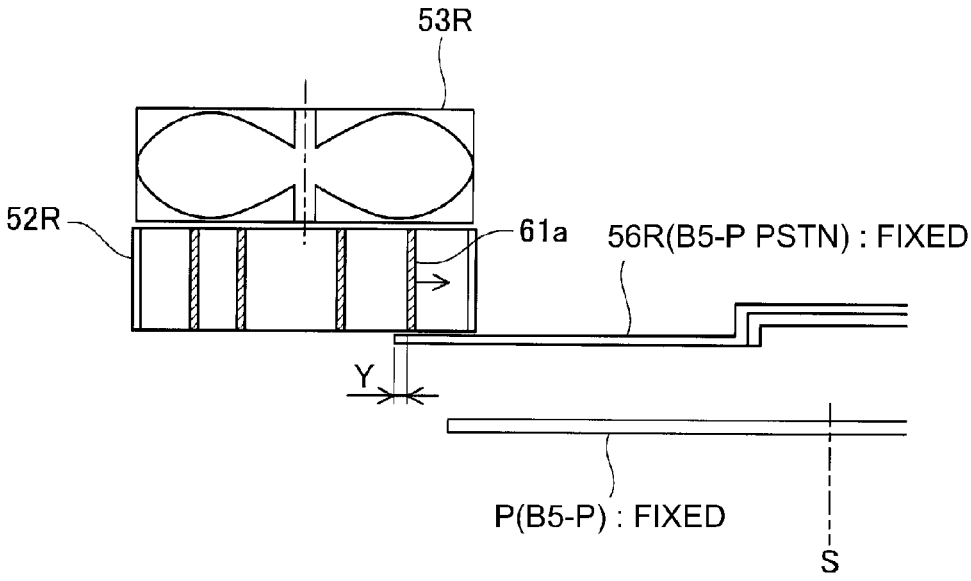
FIG. 13 is a schematic view showing a method in which a projection length of the shutter with respect to the partition is changed in Embodiment 2.
Figure 14:
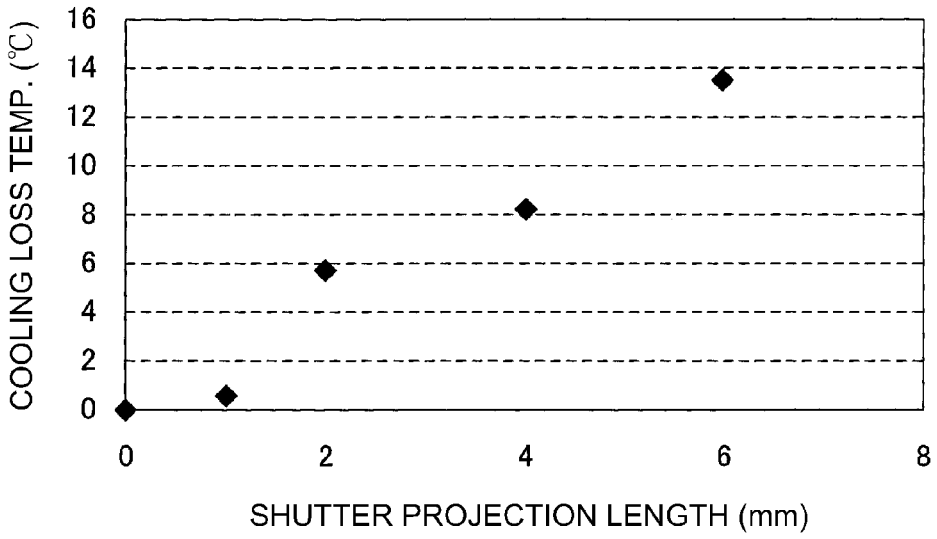
FIG. 14 is a graph showing a relationship between a projection length of the state with respect to the partition and a cooling loss temperature.

FIG. 12 is a cross-sectional front view for illustrating a positional relation between the partitions 61 inside the cooling duct 52 and regular papers assured by the image forming apparatus. FIG. 13 is a cross-sectional front view showing a method in which a projection length of the shutter 56 with respect to the partition 61*a* in the cooling duct 52 is changed. FIG. 14 is a graph showing a relationship between a projection length of the shutter 56 with respect to the partition 61*a* in the cooling duct 52 and a cooling loss temperature. Incidentally, constituent portions which are the same as those in Embodiment 1 are represented by the same reference numerals or symbols and will be omitted from description.

As shown in FIG. 12, positions of a plurality of partitions 61 provided inside the cooling duct 52 correspond to positions located somewhat outside of widthwise ends of associated regular papers, by a length X, assured by the image forming apparatus. Here, in the case where the partitions 61 are not disposed substantially in parallel to the recording material conveyance direction, an end position of each partition close to the fixing mechanism portion 20A (at the air-blowing opening side) may preferably be set so as to be spaced from the widthwise end of the associated recording material by a preset length.

Further, a stop position of the shutter 56R for changing the opening width of the air-blowing opening depending on the widthwise length of each of the regular papers is constituted so as to be located in the neighborhood of the partition 61 provided correspondingly to the associated regular paper. The stop position of the shutter 56R shown in FIG. 12 corresponds to a position at the time when the recording material with the B5 size width of 182 mm is passed through the fixing device (B5-P (portrait) feeding). Incidentally, in this embodiment, one cooling duct 52R is described but the above description is also true for the other cooling duct 52L, and the cooling ducts 52R and 52L provide a symmetrical relationship with respect to the center reference line S (longitudinal center line of the film 33).

In actuality, the projection length of the shutter 56 with respect to the partition 61 disposed inside the cooling duct 52 was changed and at some projection positions, the surface temperature of the film 33 corresponding (opposing) to the end portion (projection portion) of the shutter 56 was detected.

As shown in FIG. 13, the projection length of the shutter 56 was changed by moving only the partition 61*a* disposed inside the cooling duct toward the center of the paper while fixing a position of the paper having the B5-size width of 182 mm (B5-P feeding) and a stop position of the shutter 56 corresponding to the B5-P feeding. That is, only the projection length Y of the shutter 56 was changed without changing the opening width of the cooling duct 52. A relationship at this time between the shutter projection length and a cooling loss temperature (a temperature difference from the surface temperature of the film 33 when the shutter projection length is zero) is shown in FIG. 14.

As shown in FIG. 14, when the projection length of the shutter 56 with respect to the partition 61*a* inside the cooling duct 52 is about 1 mm, even when the cooling air runs against the wall surface of the shutter 56, the influence of the flow of the curled or curved air generated in the neighborhood of the shutter 56 is a little. Therefore, in such a case, the cooling amount of the non-sheet-passing portion does not become non-uniform with respect to the longitudinal direction.

As shown in FIG. 14, when the projection length of the shutter 56 with respect to the partition 61 inside the cooling duct 52 is 0 mm, i.e., when the stop position of the shutter 56 coincides with (contacts) the partition 61 corresponding to each of the regular papers, there is no cooling loss. This is because, in this case, the cooling air does not run against the wall surface of the shutter 56 and therefore there is no occurrence of the curling of the air or the flow of the curved air. Therefore, it is preferable that the position of the end portion (close to the fixing mechanism portion 20A) of the partition 61 and the position of the end portion of the shutter 56 with respect to the longitudinal direction coincide with (contact) each other. Further, by the coincidence between the end portions of the partition 61 and the shutter 56, of the whole region of the air-blowing opening, a region toward the sheet passing region move than the partition 61 with respect to the longitudinal direction is closed (covered).

As described above, in this embodiment, the partition 61 disposed inside the cooling duct 52 is associated with the position of each of the regular papers assured by the image forming apparatus, and the shutter 56 for changing the opening width of the air-blowing opening is located in the neighborhood of the partition 61.

By employing such a constitution, it becomes possible to prevent the occurrence of the curling of the air and the flow of the curved air in the neighborhood of the shutter due to the running of the cooling air against the shutter wall surface. For that reason, the influence of the loss of the air volume in the neighborhood of the shutter 56 can be prevented, so that it becomes possible to uniformize the cooling amount of the non-sheet-passing portion with respect to the longitudinal direction without lowering the volume of the air flowing from the cooling fan. Therefore, the temperature non-uniformity in the sheet passing region and the excessive temperature rise in the non-sheet-passing region can be prevented, so that it becomes possible to prevent the conveyance speed down and the fixing non-uniformity such as uneven glossiness of the image with respect to the small-sized recording material.

In this embodiment, as the constitution capable of preventing the occurrence of the curling of the air or the flow of the curved air in the neighborhood of the shutter due to the running of the cooling air against the shutter wall surface, the relationship between the position of the partition 61 and the stop position of the shutter 56 was described.

Here, even in the constitution in which the partitions are provided irrespective of the stop position of the shutter 56 as in Embodiment 1, the inside of the cooling duct 52 is constituted by the plurality of air paths by the presence of the partitions, so that the direction of the cooling air blown from the cooling fan 53 can be set at one direction. In such a constitution, even when the cooling air runs against the shutter wall surface, by the presence of the partitions, the influence on the air path along which there is no shutter is alleviated. Therefore, by employing the constitution in which the partitions are provided, compared with the conventional constitution in which there is no partition, the influence of the loss of the air volume in the neighborhood of the shutter can be suppressed, so that an effect of uniformizing the cooling amount of the non-sheet-passing portion with respect to the longitudinal direction.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 102994/2011 filed May 2, 2011, which is hereby incorporated by reference.

What is claimed is:

1. An image fixing apparatus comprising:

a rotatable fixing member configured to form a nip for conveying a recording material bearing an unfixed image;

an air-blowing unit configured to blow air onto an end portion of said rotatable fixing member with respect to a generatrix direction of said rotatable fixing member, wherein said air blowing unit includes a fan, a duct configured to guide the air generated by driving of the fan; and a partition, provided in a wall forming the duct, configured to partition an air passing region inside the duct into a plurality of regions with respect to a rotational direction of said rotatable fixing member.

2. An apparatus according to claim 1, wherein the air from said duct is blown onto a region downstream of the nip of said rotatable fixing member with respect to the rotational direction of said rotatable fixing member.

3. An apparatus according to claim 1, further comprising a shutter, provided at an outlet of the duct, configured to switch an outlet width of the duct with respect to the generatrix direction.

4. An apparatus according to claim 3, further comprising a second partition, provided in a wall forming the duct, configured to partition an air passing region inside the duct into a plurality of regions with respect to the generatrix direction.

5. An apparatus according to claim 4, wherein said second partition extends to a neighborhood of the shutter with respect to an air blowing direction.

6. An apparatus according to claim 4, wherein said second partition is disposed to correspond to a width of a recording material having a regular size.

7. An apparatus according to claim 4, wherein the shutter moves depending on the size of the recording material.

8. An apparatus according to claim 7, wherein the shutter stops, after moving, depending on the size of the recording material, at a position projected from said second partition by a predetermined width.

9. An apparatus according to claim 1, wherein the fan starts to be driven when the temperature of said rotatable fixing member at the end portion thereof is increased up to a predetermined drive temperature.

10. An apparatus according to claim 1, wherein said rotatable fixing member is an endless belt.

11. An apparatus according to claim 10, further comprising a heater contacting an inner surface of the endless belt and a roller configured to form the nip, between itself and the endless belt, in which the recording material is to be heated.

12. An apparatus according to claim 8, wherein the predetermined width is not more than 1 mm.

13. An apparatus according to claim 8, further comprising a sensor configured to sense a home position of the shutter, wherein the amount of movement of the shutter is set by controlling the amount of rotation of a motor configured to move the shutter.

* * * * *